US007440580B2

(12) United States Patent
Grimani et al.

(10) Patent No.: US 7,440,580 B2
(45) Date of Patent: Oct. 21, 2008

(54) ROOM MODE BASS ABSORPTION THROUGH COMBINED DIAPHRAGMATIC AND HELMHOLTZ RESONANCE TECHNIQUES

(75) Inventors: Anthony Grimani, Fairfax, CA (US); Evan Reiley, Woodcare, CA (US)

(73) Assignee: Performance Media Industries, Ltd., Fairfax, CA (US)

( * ) Notice: Subject to any disclaimer, the term of this patent is extended or adjusted under 35 U.S.C. 154(b) by 284 days.

(21) Appl. No.: 10/542,465

(22) PCT Filed: Jan. 16, 2004

(86) PCT No.: PCT/US2004/001142

§ 371 (c)(1),
(2), (4) Date: Jul. 15, 2005

(87) PCT Pub. No.: WO2004/066668

PCT Pub. Date: Aug. 5, 2004

(65) Prior Publication Data

US 2006/0147077 A1 Jul. 6, 2006

(51) Int. Cl.
*H04R 25/00* (2006.01)

(52) U.S. Cl. ..... 381/353; 381/345; 381/346

(58) Field of Classification Search ..... 381/345–349, 381/351–353

See application file for complete search history.

(56) References Cited

U.S. PATENT DOCUMENTS

| | | | | |
|---|---|---|---|---|
| 6,778,673 | B1 * | 8/2004 | Hobelsberger | 381/96 |
| 7,206,425 | B2 * | 4/2007 | Vaudrey et al. | 381/328 |
| 7,212,641 | B2 * | 5/2007 | Sheplak et al. | 381/181 |
| 7,261,182 | B2 * | 8/2007 | Zainea | 181/293 |

* cited by examiner

*Primary Examiner*—Suhan Ni
(74) *Attorney, Agent, or Firm*—Craig M. Stainbrook; Stainbrook & Stainbrook, LLP

(57) ABSTRACT

An acoustical bass absorber which reduces peak and dip frequency response errors caused by interference from naturally occurring axial standing waves in rectangular rooms. The apparatus uses two forms of simple harmonic resonance: pistonic diaphragm resonance and Helmholtz cavity resonance. The pistonic diaphragm resonance is achieved by attaching a rigid planar membrane to metal springs. The Helmholtz cavity resonance is achieved by constructing an enclosed chamber attached to an open cylindrical tube. Coupling these two dissipation devices leads to several-fold improvement in absorption and total room mode attenuation.

9 Claims, 2 Drawing Sheets

ROOM MODE BASS ABSORPTION THROUGH COMBINED DIAPHRAGMATIC AND HELMHOLTZ RESONANCE TECHNIQUES

BACKGROUND OF THE INVENTION

1. Technical Field

The present invention relates generally to acoustics, and more particularly to an improved method and apparatus to reduce frequency response errors in small room acoustics.

2. Background Art

One challenge of small room acoustics is reducing frequency response errors introduced by standing waves, also known as "room modes". There are many references on room modes in the literature, see, for example, P. M. Morse, *Vibration and Sound,* (McGraw Hill, N.Y. 1948), p. 313, 418; P. M. Morse and K. U. Ingard, *Theoretical Acoustics,* (McGraw Hill, N.Y., 1968), p. 576-598; J. Borwick (ed.), *Loudspeaker and Headphone Handbook,* (McGraw Hill, N.Y., 1968), ch. 7; and T. Welti, "How Many Subwoofers Are Enough", presented at the AES112$^{th}$ Convention, Munich, Germany, 2002 May 10-13. Usually narrow in bandwidth, these frequency response errors can be up to 40 decibels in magnitude and are spatially variable within the listening environment. To achieve an accurate frequency response and consistent sound quality at all listener locations, the room modes can be controlled through absorption.

Sound Absorption Methods: Techniques for attenuating sound waves are resistive absorption, resonant absorption, and active cancellation.

Resistive Absorption: Resistive absorption reduces sound energy by dissipating it as heat. Resistive absorption is maximized where air particles exhibit maximum velocity and is minimized where they exhibit maximum pressure. High-density fiberglass insulation, mineral wool, open cell foam, and heavy velour drapes are examples of resistive absorbers. Deficiencies of resistive absorption are its broad frequency range of absorption (narrow band absorption is preferable for treating room modes, so non-modal frequencies are unaffected), and that it requires significant depth and area of material in the room to be effective at the low frequencies typical of room modes.

Because room boundaries are the most common locations for acoustical treatments, resistive absorption is not an effective method of standing wave absorption. A standing wave exhibits a pressure maximum and a velocity minimum at the room boundary. In order for a resistive absorber to be effective in absorbing a room mode standing wave, it must be located at least a quarter wavelength distance (relative to the frequency being absorbed) in from the room boundary. A standing wave exhibits a velocity maximum at its quarter wavelength. It is generally not practical to place acoustical treatments more than a few inches inward in the room from the room's boundary—low frequencies typical of room modes would potentially require treatments to be suspended one to three feet inward from the room's boundary.

Resistive absorption is more commonly used to shorten reverberation decay, eliminate flutter echoes, and to attenuate detrimental mid and high frequency reflections in the listening environment.

Resonant Absorption: Resonant absorption reduces sound energy by establishing a sympathetic resonance with the sound wave and applying a damping force to the resonant oscillation. Damping can be achieved by various methods. Resonant absorption is maximized where air particles exhibit maximum pressure and is minimized where they exhibit maximum velocity. Therefore, this method is ideally suited to applications at room boundaries, where pressure is maximized.

One type of resonant absorber is a tympanic diaphragm. Like a drum, the diaphragm is stretched over an airtight, enclosed chamber. A diaphragm absorber is tuned to the modal frequency and positioned at a pressure maximum (room boundary). Diaphragm mass density, enclosure air depth, and diaphragm tension establish the resonant frequency. When sound waves strike the diaphragm's surface, it resonates sympathetically. The diaphragm's tympanic flexing dissipates sound energy as heat and causes damping of the resonance. Although constructing accurately tuned diaphragm absorbers is difficult, it is possible to achieve a narrow frequency range of absorption (avoiding attenuation of adjacent non-modal frequencies). Adding resistive absorption material inside the air cavity of the tympanic absorber broadens the frequency range of absorption yet reduces the magnitude of absorption. Construction guidelines and background on tympanic diaphragm absorbers are common in the literature (see, e.g., A. Everest, *Master Handbook Of Acoustics,* McGraw Hill, NY, 2001, p. 205, p. 215-218).

A second resonant absorber is a pistonic diaphragm. The pistonic diaphragm is a rigid planar membrane with minimal tympanic flexing character. The goal with a pistonic membrane absorber is to excite the membrane in a purely perpendicular motion relative to the wave front (not to excite the complex drum-like flexing of tympanic resonant absorbers). The membrane is attached to mechanical springs that impose oscillation damping. As the membrane oscillates sympathetically in a pistonic motion perpendicular to the wave front, spring compression and expansion dissipate sound energy as heat. The membrane mass and spring constant determine the resonant frequency. Pistonic diaphragm absorbers are easily tuned and possess a narrow frequency range of absorption. The magnitude of absorption of pistonic diaphragms depends on the damping character of the springs employed in the design.

HO Cinema (BP 15, 36, rue Marcel-Deneux, 60780 Viller-St-Paul, France) makes one available form of a combination pistonic and tympanic diaphragm absorber. HO Cinema's absorber uses rubber spring strips which possess a significant resonant damping character. Sheets of drywall are attached to a system of tracks which sandwich the rubber springs between the drywall and the wall framing. As this system is a combination of pistonic and tympanic resonance, its bandwidth of absorption is broader than other absorption methods.

One deficiency of tympanic and pistonic diaphragm absorbers is that they can reradiate the sound energy of the standing wave into the room at a later time. The delayed reradiation of the sound energy is pyschoacoustically undesirable in a listening environment. Similar to echoes in a reverberant space, delayed radiation of bass energy in a modal environment seriously distracts from the desired effect of the program material (see Everest, supra).

Another resonant absorber is a Helmholtz cavity. A Helmholtz cavity is an enclosed chamber attached to an open cylindrical tube. The chamber's air volume and the tube length and diameter determine the resonant frequency. The tube opening is located at a pressure maximum. When sound waves encounter the tube opening, the cavity resonates sympathetically (similar to blowing on the mouth of a wine bottle). As the air in the tube and cavity compresses and expands, sound energy is dissipated by friction imposed by the column of air moving in and out of the tube. A challenge with Helmholtz absorbers is that the chamber must be very large to achieve low frequency resonance (in the region of frequency relevant to small room acoustics). Another limitation is the absorption coefficient produced by the resonance is considered to be applicable only over the tube opening area; numerous absorbers may be required to attenuate room modes (see Everest, supra). Two benefits of Helmholtz absorbers are that they are easily tuned and possess a narrow frequency range of absorption.

An example of an application of Helmholtz cavity absorbers exists today built into the ceiling of the Royal Festival Hall in London, England, designed by the architecture team of Sir Robert Mathew and Dr. Leslie Martin in 1949 (see B. Shield, *The Acoustics Of The Royal Festival Hall,* South Bank University, London, http://www.ioa.org.uk/articles/Rfh/rfh1.html). The Helmholtz cavities were tuned in the mid-frequency band (not for low frequency correction of standing waves) to reduce mid-frequency reverberation the hall. It was determined after construction however that too much attenuation had been achieved and some of the cavities were later filled. For more background on Helmholtz absorbers consult Everest, supra, and H. Olson, Acoustical Engineering, (D. Van Nostrand Co., Princeton, N.J., 1957), p. 508.

Active Cancellation: Another approach for attenuating room modes may be active cancellation. Active cancellation would inject a signal into the room at equal amplitude and opposite polarity as the standing wave, resulting in cancellation. An example of active sound cancellation has been produced by Sound Physics Labs in its airport runway noise suppression experiments using high-output subwoofer arrays in conjunction with phase-locked loop detectors (see C. Hobbs, *Servodrive And Sound Physics Labs Speakers Reproduce Jet Engine SPLs For Noise Mitigation Research*, http://www.ProSoundWeb.com/news/news01/servonoise.html). Similar research has also been conducted at Virginia Tech University on aircraft cabin noise suppression methods (see C. Fuller and A. Von Flotow, *Active Control Of Sound And Vibration.* "IEEE Control Systems Journal, vol 15, number 6, 9-19 http://www.val.me.vt.edu/General%20Information/GIslide.html). Active cancellation appears much more complicated than passive mechanical solutions.

The foregoing discussion reflect the current state of the art of which the present inventors are aware. Reference to and discussion of the related prior art is intended to aid in discharging Applicant's acknowledged duty of candor in disclosing information that may be relevant to the examination of claims to the present invention. However, it is respectfully submitted that none of the above-indicated technologies disclose, teach, suggest, show, or otherwise render obvious, either singly or when considered in combination, the invention described and claimed herein.

DISCLOSURE OF INVENTION

The present invention provides an acoustical bass absorber which reduces peak and dip frequency response errors caused by interference from naturally occurring axial standing waves in rectangular rooms. The apparatus uses two forms of simple harmonic resonance: pistonic diaphragm resonance and Helmholtz cavity resonance. The pistonic diaphragm resonance is achieved by attaching a rigid planar membrane to metal springs. The Helmholtz cavity resonance is achieved by constructing an enclosed chamber attached to an open cylindrical tube. Coupling these two dissipation devices leads to several-fold improvement in absorption and total room mode attenuation.

The inventive apparatus uses the resonance character of the pistonic diaphragm to increase the magnitude of absorption of a coupled Helmholtz chamber. The damping character of the springs is minimal compared to the sound absorption from the frictional loss in the Helmholtz cavity.

It is therefore an object or feature of the present invention to provide a new and improved method and apparatus to reduce frequency response errors in small room acoustics.

It is another object of the present invention to provide an apparatus to improve the effectiveness of room mode absorption by achieving more accurate tuning of the absorption device to the target resonant frequency in the room.

It is another object of the present invention to provide an increase in the magnitude of absorption in a relatively small surface area of treatment.

It is a still further object of the present invention to provide a method and apparatus for controlling room modes to achieve accurate frequency response and consistent sound quality at all listener locations.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

BEST MODE FOR CARRYING OUT THE INVENTION

Figure 1:
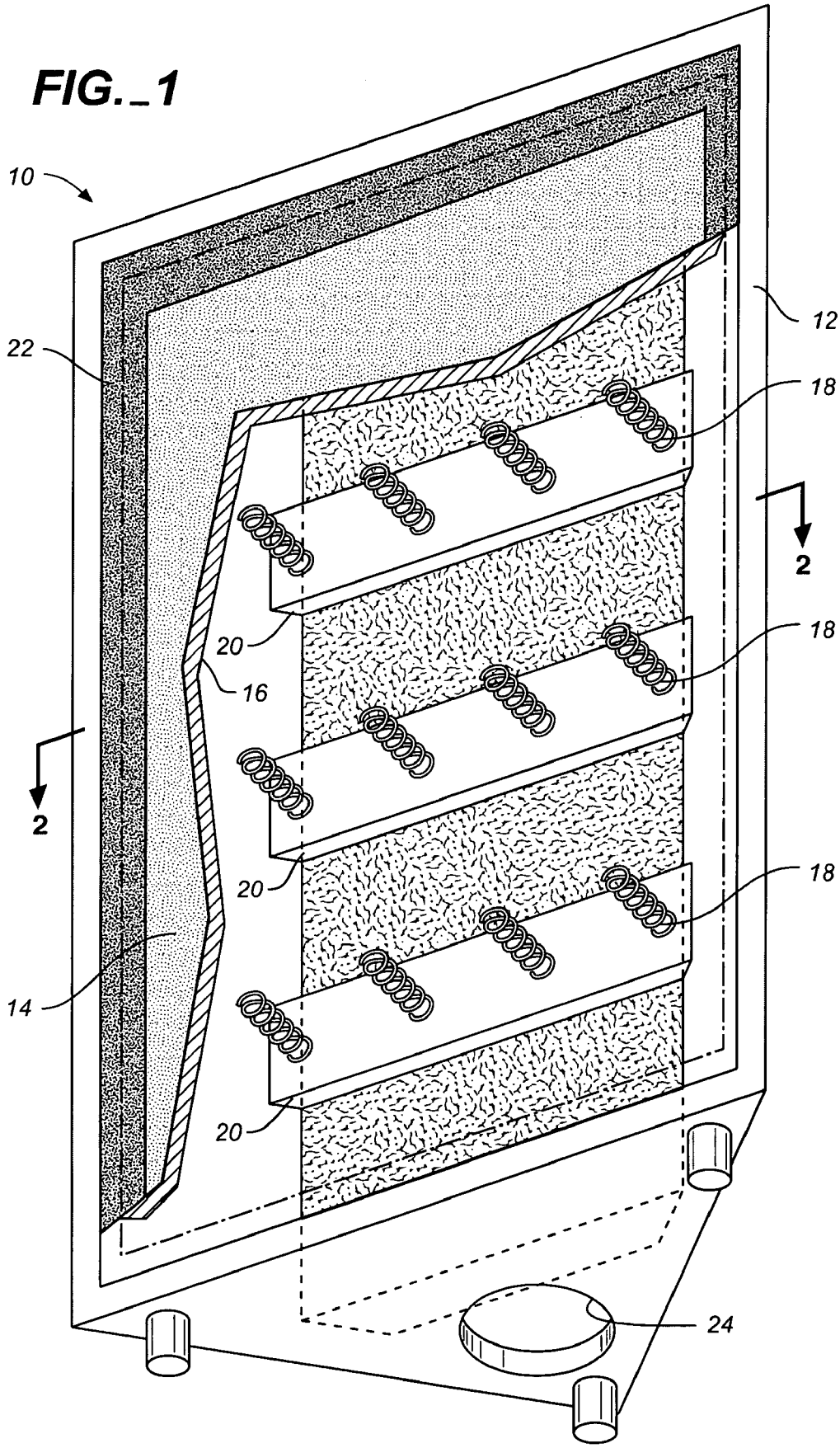
FIG. 1 is a front perspective view of an acoustical bass absorber apparatus of this invention.
Figure 2:
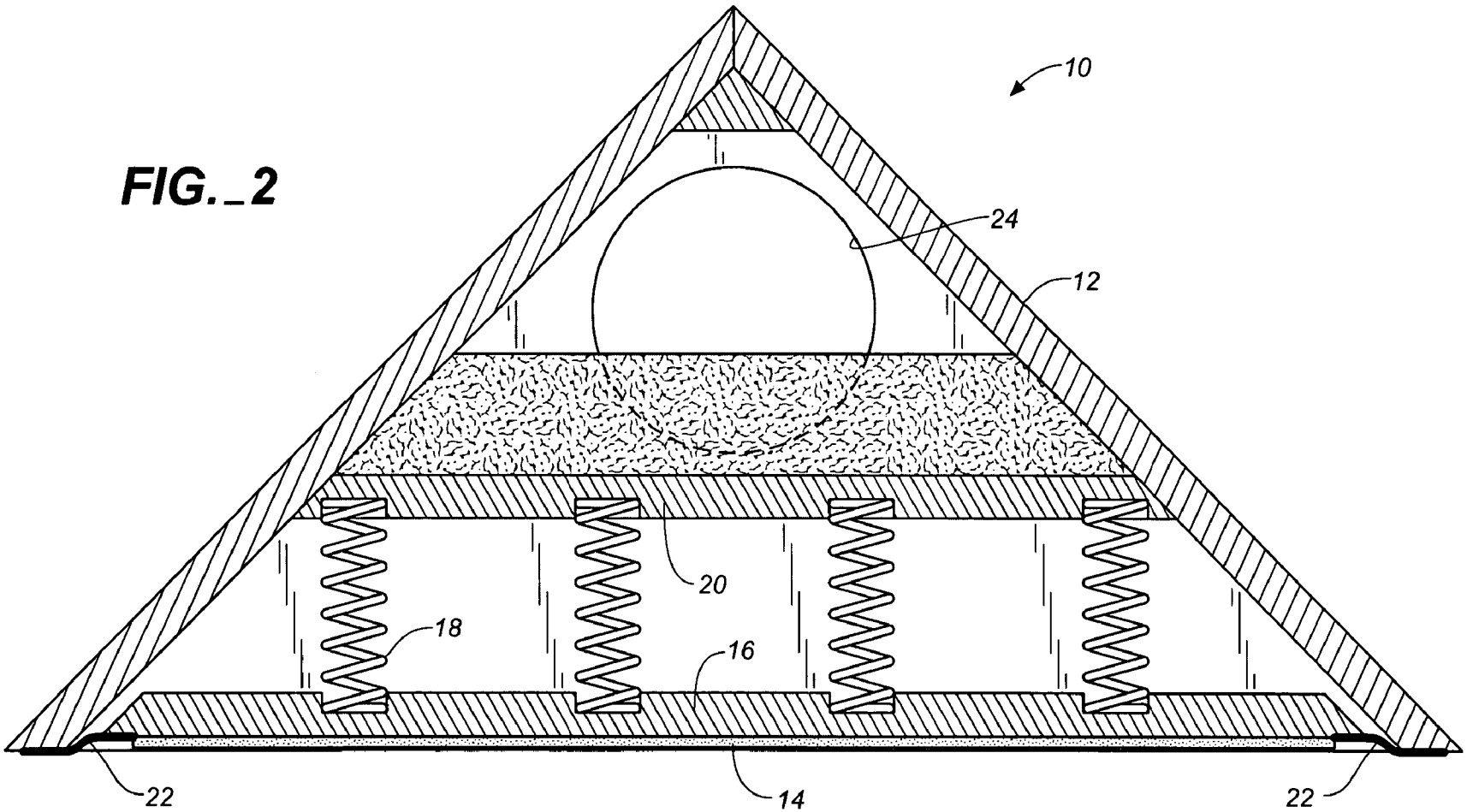
FIG. 2 is a cross-sectional view of the acoustical bass absorber apparatus of FIG. 1.

Referring to FIGS. 1 through 2, wherein like reference numerals refer to like components in the various views, FIG. 1 is a front perspective view of an acoustical bass absorber apparatus 10 of this invention; and FIG. 2 is a cross-sectional view thereof. Apparatus 10 includes a cabinet or housing portion 12 defining an internal volume. The housing 12 includes a pistonic diaphragm 14 including a front plate or rigid planar member 16 attached to one or a plurality of metal springs 18. One or more cross supports 20 secure the other end of the spring(s) 18 within the housing. Rubber gasket 22 forms an airtight seal around the entire perimeter of the front plate/housing interface. A Helmholtz resonance port hole and tube 24 is contained in the housing 14 and coupled to the pistonic diaphragm 14.

One embodiment of the inventive apparatus was motivated by the need for a custom bass absorber to attenuate room modes in a home theater installation. In this particular application, a unique limitation of the device was that the exposed surface seen inside the theater needed to be cabinet-grade wood paneling. The traditional approach of creating a tympanic diaphragm absorber was not appropriate because wood paneling would not possess the resonant flexing character of unadorned plywood or drywall, which are commonly used materials.

Instead, it was established that there was a sufficient available volume of space in the cabinet in which the absorber would be installed to allow construction of a Helmholtz:: cavity absorber, combined with a pistonic diaphragm absorber, using the rigid sheet of cabinetry panel as the planar membrane, in one device.

Qualifying A Test Room: The first step in the experiment was to select a room with a confirmed modal frequency response error in which we could test the prototype. A rectangular test room measured 11' 2½" long, 9' 11" wide, and 8' ¾" tall. The test room was examined for room mode frequency response errors, and a significant sound pressure difference of 33 dB at 52 Hz was measured between the midpoint in the room length and the extreme boundary in room length.

The predicted standing wave harmonics for a room with the dimensions above include a first order length harmonic of 50.41 Hz and a first order width harmonic at 56.98 Hz. This work focuses on the first order length harmonic response error, but may have been influenced by the first order width harmonic as well. Current literature suggests that the slight shift in frequency between the predicted modal frequency (50.4 Hz) and the measured frequency (52.0 Hz) may be attributed to asymmetry in the room's rectangular construction, geometric distortions introduced by a window and door, the sonic leakage character of the room construction, and dynamic flexing of the wall/floor/ceiling structures within the room in response to sound pressure. A discrepancy of a few percent in frequency between measured and predicted room mode frequency is common in real-world acoustical environments.

After examining the predicted modal frequencies that should be problematic in the room, we measured the acoustic response of the room. The room was completely empty except for a subwoofer and microphone. The subwoofer was playing a signal from a pure sine tone generator equipped with a sweepable frequency control. The subwoofer was located in the front right bottom corner of the room—in order to fully energize all the standing waves in the room. The microphone was located at the midpoint of length (5' 7¼"), midpoint of width (4' 11½"), and midpoint of height (4' ⅜"); such a location would place the microphone in the node location for the first harmonic standing wave in all three coordinate axes. The node is where the standing wave experiences destructive interference.

Knowing that the first harmonic standing wave in length should occur somewhere around 50.4 Hz, we swept the frequency of the sine tone generator up and down between 20 and 80 Hz and looked for a minimum amplitude level measured with the SPL meter fed by the microphone. The minimum amplitude was 93 dB SPL unweighted, given the injected signal in the room, and it occurred at a frequency of 52.0 Hz.

Next we moved the microphone so it was adjacent to the rear wall, but still at mid-width and mid-height. Without changing the level or frequency of the injected sine tone, we measured the amplitude at this location. The modal peak was 126 dB SPL at 52 Hz. This portion of the experiment established that the peak to dip amplitude difference of the first harmonic length-direction standing wave was 33 dB and at 52 Hz.

Tympanic Diaphragm Absorber: A total of twelve tympanic absorbers were constructed, all targeting 52 Hz as the resonance center frequency. Each absorber was constructed with a different diaphragm material and/or with different area dimensions in an attempt to analyze the tuning accuracy of the absorbers and the accuracy of the equation used to design the absorbers. Using an accelerometer apparatus, the resonant frequency of each tympanic diaphragm absorber was measured. Of the twelve absorbers built to a theoretical 52 Hz resonance, only one absorber ended up resonating at 52 Hz. While we were disappointed that the other eleven absorbers resonated are very different frequencies than that required, we were pleased that we had at least one functional absorber to test in the room.

The equation used to determine the construction and tuning of the absorbers was:

Equation 1: Tympanic Diaphragm Resonance $F_{resonance}=(170)/(md)^{1/2}$ where: m=mass density per area (lbs./ft.$^2$)

d=internal air depth of cavity (inches)

F=resonant frequency (Hz)

The experiment used to qualify the test room was then repeated, this time with a (4'×4'×7.37") 52 Hz tympanic diaphragm absorber in the room. The tympanic diaphragm was installed on the front wall, sitting on the ground, centered on the width of the room. The frequency and amplitude of the stimulus signal was unchanged. With the microphone located at the mid-length position, the amplitude measured 93 dB SPL. With the microphone at the rear wall position, the amplitude measured 121 dB SPL. The peak to dip difference caused by the standing wave interference was reduced from 33 dB down to 28 dB. Thus, the 4'×4' tympanic diaphragm absorber provided 5 dB of standing wave correction in the test room compared to the control.

Pistonic Diaphragm Design: After measuring the response error in the empty room and the response error with the addition of the tympanic diaphragm, it was time to develop the inventive absorber and compare results. The first stage was to design the pistonic diaphragm portion of the apparatus. The sample piece of cabinetry fascia was 49¼" long, 17½" tall, and approximately ⅝" thick. It weighed 10 lbs. (4.536 kg). The equation that relates diaphragm mass, spring constant, and resonant frequency is below:

Equation 2: Pistonic Spring & Mass Resonance $F_{resonance}=(1/2\pi)*(k/m)^{1/2}$ where: k=spring constant (N/m)
m=mass (kg)
F=resonant frequency (Hz)

The resulting necessary spring constant was calculated to be 2764.8 lbs./inch deflection. Due to the confined area of the fascia and the need for uniform spring constant across the fascia, we opted to distribute the total spring constant across twelve identical springs, each with a spring constant of 230.4 lbs./inch deflection. The springs were equidistantly spaced on the rectangular face of the cabinetry fascia to achieve as uniform a spring constant as possible across the diaphragm. The springs were manufactured with a tolerance of +/−5% in spring constant value.

Once the apparatus was completely assembled, the mechanical resonance of the spring/cabinetry fascia combination was measured with an accelerometer apparatus. The resonance center frequency was 51.6 Hz. The pistonic portion of the apparatus fell within 1% of the target resonant frequency.

Helmholtz Cavity Design: The next stage of the prototype design was to calculate the dimensions of the Helmholtz cavity so that it would fit it in the allocated volume inside the cabinet while still resonating at 52 Hz. Below is the equation that determines the resonant frequency of the cavity:

Equation 3: Helmholtz Cavity Resonance $F^{resonance}=[(2160)*(\pi r^2)]/[\pi r^2 ldhw]^{1/2}$ where: r=radius of cylindrical tube (inches)
l=length of cylindrical tube (inches)
d=internal depth of cavity (inches)
h=internal height of cavity (inches)
w=internal width of cavity (inches)
F=resonant frequency (Hz)

The finished dimensions of the Helmholtz cavity were as follows:

r=6", h=16", w=47¾", d=20", l=12¾".

Construction: We attached the springs with equidistant spacing onto the backside of the cabinetry fascia. Next we created wooden sockets fastened onto the inner side of the back plate of the Helmholtz cavity into which the other ends of the springs were attached. At this point the pistonic diaphragm portion of the apparatus was complete.

Next we formed an "O-ring" rubber gasket around the perimeter of the front face of the cabinetry fascia. The gasket was created from tire inner-tubes. An airtight seal was created between the gasket and the cabinetry fascia A 1' ½ diameter circular hole was cut in the center of the top plate of the Helmholtz cavity. A cardboard cylindrical tube was glued into the hole with an airtight seal.

The top, bottom, and side plates were screwed and glued onto the back plate of the Helmholtz cavity. The finishing step was then to attach the rubber gasket from the cabinetry fascia (front plate of the Helmholtz cavity) onto the top, bottom, and sides of the Helmholtz cavity.

The result was an airtight rectangular chamber with the front plate attached with a flexible airtight gasket, connected to a cylindrical tube with one end open to the outside atmosphere on the top plate of the chamber.

Experiment: After moving the roughly 350 lb. prototype into the test room described earlier, we repeated the test of room mode correction. The apparatus was installed on the front wall, sitting on the ground, centered on the width of the room. The frequency and amplitude of the stimulus signal was unchanged. With the microphone located at the mid-length position, the amplitude measured 102 dB SPL. With the microphone at the rear wall position, the amplitude measured 113 dB SPL. The peak to dip difference caused by the standing wave interference was reduced from 33 dB down to 11 dB. Thus, the apparatus provided 22 dB of standing wave interference correction in the test room.

How the Apparatus Works: When modal frequency wave fronts strike the spring-loaded membrane, it resonates sympathetically. The membrane resonance causes the Helmholtz cavity to resonate. The dual effects of damping from the springs and frictional loss from the Helmholtz tube account for absorption at the standing wave frequency. Although the inventive apparatus is much deeper than the tympanic absorber described earlier, its membrane is less than half the area The experimental results indicate an improved passive mechanical method of room mode bass absorption. The apparatus is also easier to tune than traditional tympanic diaphragm absorbers, and it provides more than four times the correction in half the surface area.

Results

| Condition | Modal Error | Correction | Area |
|---|---|---|---|
| Empty room | 33 dB error | none | na |
| w/tympanic | 28 dB error | 5 dB | 16 ft.$^2$ |
| w/invention | 11 dB error | 22 dB | 6 ft.$^2$ |

Accordingly, the present invention may be characterized as an acoustical bass absorber apparatus for reducing frequency response errors introduced by standing waves, including a housing portion defining an internal volume; a pistonic diaphragm contained within the housing portion, the pistonic diaphragm including a front plate attached to at least one spring; at least one cross support securing the at least one spring within the housing portion; and a Helmholtz cavity resonance port hole and tube contained in the housing portion and coupled to the pistonic diaphragm.

Alternatively, the instant invention may be characterized as a method for controlling room modes to achieve accurate frequency response and consistent sound quality at all listener locations, comprising the steps of: providing a housing defining an internal volume; providing a pistonic diaphragm within the housing, the pistonic diaphragm including a front plate attached to a spring; securing the spring to a cross support within the housing portion; and coupling a Helmholtz cavity resonance port hole and tube to the pistonic diaphragm within the housing.

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. An acoustical bass absorber apparatus for reducing frequency response errors introduced by standing waves, said apparatus comprising:

a housing portion defining an internal volume;

a pistonic diaphragm contained within said housing portion, said pistonic diaphragm including a front plate attached to at least one spring;

at least one cross support securing said at least one spring within said housing portion; and a Helmholtz cavity port hole and tube contained in said housing portion and coupled to said pistonic diaphragm;

wherein said apparatus is tuned mechanically by balancing the mass of said pistonic diaphragm, the hardness of said spring, and the airmass resonances in the internal volume of said housing portion.

2. The acoustical bass absorber apparatus of claim 1 wherein said at least one spring comprises a plurality of springs arrayed to distribute the spring constant.

3. The acoustical bass absorber apparatus of claim 1 wherein said housing portion comprises an airtight chamber.

4. The acoustical bass absorber apparatus of claim 1 further including a rubber gasket forming an airtight seal between said front plate and said housing portion.

5. A method for controlling room modes to achieve accurate frequency response and consistent sound quality at all listener locations, said method comprising the steps of:

providing a housing defining an internal volume;

providing a pistonic diaphragm within the housing, the pistonic diaphragm including a front plate attached to a spring;

securing the spring to a cross support within the housing portion; and coupling a Helmholtz cavity port hole and tube to the pistonic diaphragm within the housing.

6. The method for controlling room modes to achieve accurate frequency response and consistent sound quality of claim 5 further including the step of:

arraying a plurality of springs to the front plate to distribute the spring constant.

7. The method for controlling room modes to achieve accurate frequency response and consistent sound quality of claim 5 further including the step of:

forming an airtight seal between said front plate and said housing portion.

8. The method for controlling room modes to achieve accurate frequency response and consistent sound quality of claim 5 further including the step of:

selecting the diaphragm mass and spring constant of the pistonic diaphragm to achieve a desired resonant frequency.

9. The method for controlling room modes to achieve accurate frequency response and consistent sound quality of claim 5 further including the step of:

selecting the dimensions of the Helmholtz cavity to achieve a desired resonant frequency.

* * * * *